United States Patent [19]

Olivieri

[11] Patent Number: 4,598,486

[45] Date of Patent: Jul. 8, 1986

[54] PROTECTIVE SOLE ASSEMBLY

[75] Inventor: Icaro Olivieri, Westmount, Canada

[73] Assignee: Warrington Inc., Montreal, Canada

[21] Appl. No.: 691,741

[22] Filed: Jan. 15, 1985

[30] Foreign Application Priority Data

Jan. 19, 1984 [CA] Canada ..... 445601

[51] Int. Cl.[4] ..... A43B 7/14

[52] U.S. Cl. ..... 36/96; 36/30 R; 36/107

[58] Field of Search ..... 36/96, 32 R, 30 R, 107, 36/108, 30, 31

[56] References Cited

U.S. PATENT DOCUMENTS

| | | | |
|---|---|---|---|
| 1,854,030 | 4/1932 | Heller | 36/108 |
| 2,009,684 | 7/1935 | Affronte | 36/108 |
| 2,024,729 | 12/1935 | Gustin | 36/108 |
| 2,082,891 | 6/1937 | Hubbard | 36/71 |
| 2,322,297 | 6/1943 | Jalbert | 36/108 |
| 2,407,498 | 9/1946 | Johnson | 36/108 |
| 2,637,122 | 4/1953 | Baer | 36/8.5 |
| 2,677,902 | 4/1954 | Everston | 36/8.5 |
| 3,398,468 | 8/1968 | Weitzner | 36/96 |
| 4,271,607 | 6/1981 | Funck | 36/107 |
| 4,404,757 | 9/1983 | Sweeny | 36/34 R |
| 4,527,345 | 7/1985 | Lopez | 36/31 |

FOREIGN PATENT DOCUMENTS

| | | | |
|---|---|---|---|
| 201471 | 4/1955 | Australia . | |
| 842167 | 3/1953 | Fed. Rep. of Germany . | |
| 2140573 | 8/1971 | Fed. Rep. of Germany | 36/108 |
| 465968 | 6/1937 | United Kingdom . | |

*Primary Examiner*—Werner H. Schroeder
*Assistant Examiner*—Mary A. Ellis
*Attorney, Agent, or Firm*—Schwartz, Jeffery, Schwaab, Mack, Blumenthal & Evans

[57] ABSTRACT

A sole construction for protective shoes comprises a protective mid-sole and an integrally molded insole and heel plug, the plug portion including a top surface, a recessed bed in the top surface, spaced-apart anchoring projections in the recessed bed and a slot extending through the insole laterally thereof adjacent the plug and communicating with the recessed bed. The mid-sole being coextensive with the insole and including a rearward extension adapted to pass through the slot in the insole and be received in the recessed bed. The rearward extension of the mid-sole includes complementary anchoring seats adapted to be selectively engaged by at least one of the anchoring projections in the bed.

3 Claims, 7 Drawing Figures

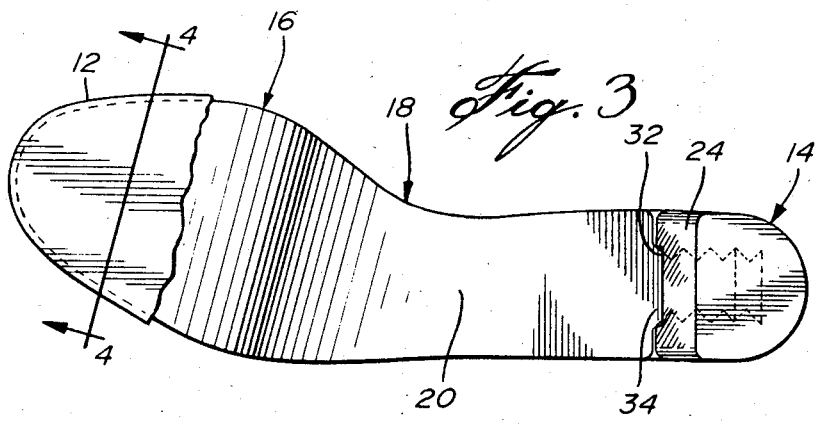
Fig. 3
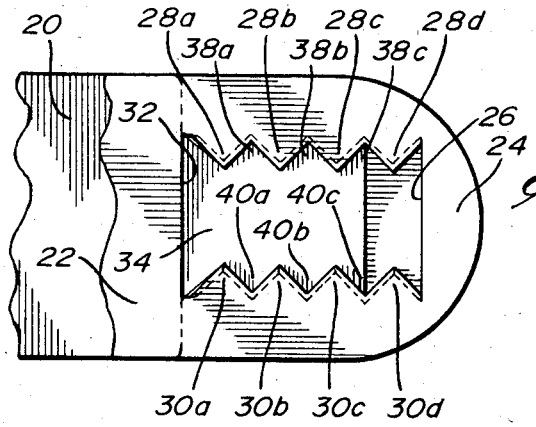
Fig. 5
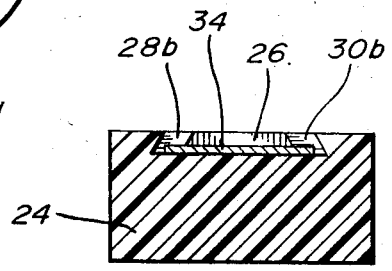
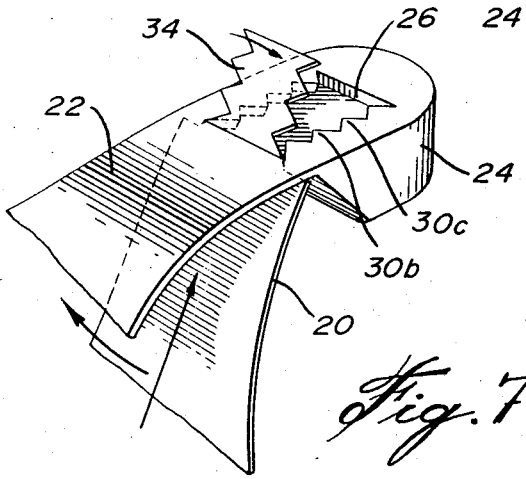
Fig. 6
Fig. 7

PROTECTIVE SOLE ASSEMBLY

BACKGROUND OF THE INVENTION

1. Field of the Invention

The present invention relates to footwear, and in particular, to a protective sole construction for a work boot or shoe, hiking boot or the like.

2. Description of the Prior Art

This type of footwear, generally referred to as protective footwear, is subject to stringent requirements and is usually constructed with a steel toe cap and a stainless steel alloy mid-sole to resist sole penetration by nails, etc. The stainless steel alloy mid-sole must be accurately positioned and embedded in the sole made of a material such as a nitrile rubber. It is also preferable in such sole constructions to provide a heel filler plug which will reduce the volume of nitrile rubber utilized and thus the time required to vulcanize it. By selecting a suitable plug, the heel can also be made more rigid. In addition to the above elements, it is required to have an insole above the mid-sole in the sole construction. The insole should be somewhat flexible and can be made of a suitable plastics material.

U.S. Pat. No. 4,404,757, Sweeny, Sept. 20, 1983, attempts to solve many of the above problems by providing a molded heel plug with projections for anchoring a steel mid-sole. The Sweeny sole comprises three pieces, including an insole, which must be located on the last before the sole material can be molded thereto.

SUMMARY OF THE INVENTION

It is an aim of the present invention to provide an improvement over the Sweeny construction by providing, for instance, fewer elements in the sole construction while maintaining the same advantages, such as accurate location of the protective stainless steel mid-sole and the provision of a filler plug.

It is a further aim of the present invention to provide a means for anchoring the protective mid-sole to the heel plug which is adjustable for length.

A construction in accordance with the present invention comprises, in combination, a protective mid-sole and an integrally molded insole and heel plug, the plug portion including a top surface, a recessed bed in the top surface, spaced-apart anchoring projections in the recessed bed, a slot extending through the insole laterally thereof adjacent the plug and communicating with the recessed bed, a protective mid-sole co-extensive with the insole and including a rearward extension adapted to pass through the slot in the insole and be received in the recessed bed, the rearward extension of the mid-sole including complementary anchoring seats adapted to be selectively engaged by at least one of the anchoring projections in said recessed bed.

BRIEF DESCRIPTION OF THE DRAWINGS

Having thus generally described the nature of the invention, reference will now be made to the accompanying drawings, showing by way of illustration, a preferred embodiment thereof, and in which:

FIG. 3 is a fragmentary bottom plan view of a sole construction in accordance with the present invention;

FIG. 5 is an enlarged fragmentary view of a detail of the construction;

FIG. 6 is a vertical cross-section taken along line 6—6 of FIG. 1; and FIG. 7 is a fragmentary view showing a detail of FIG. 5 but in a different position.

DESCRIPTION OF THE PREFERRED EMBODIMENTS

Figure 1:
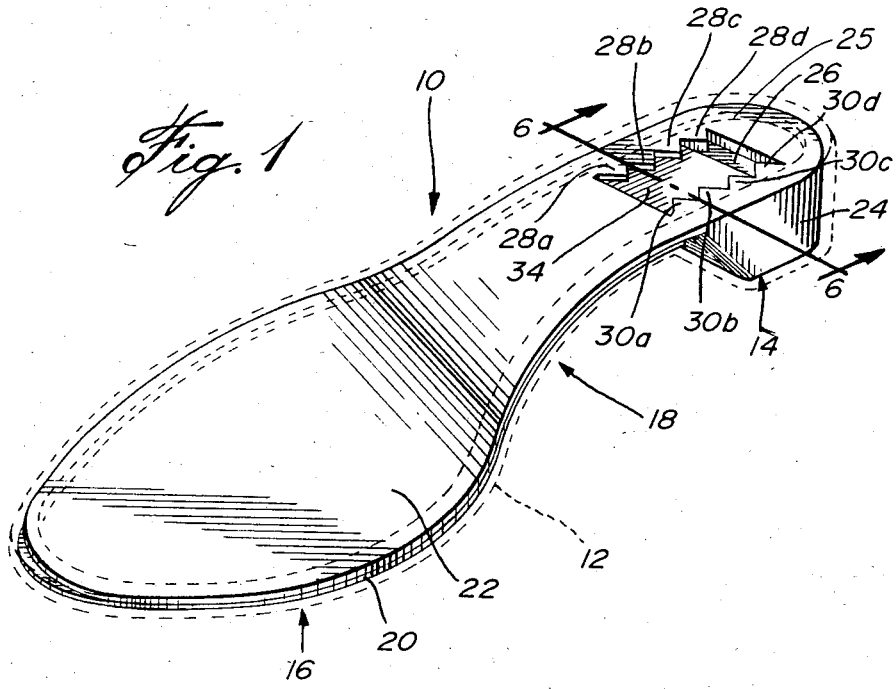
FIG. 1 is a perspective view of a typical sole construction showing the outer sole and heel in dotted lines.
Figure 2:
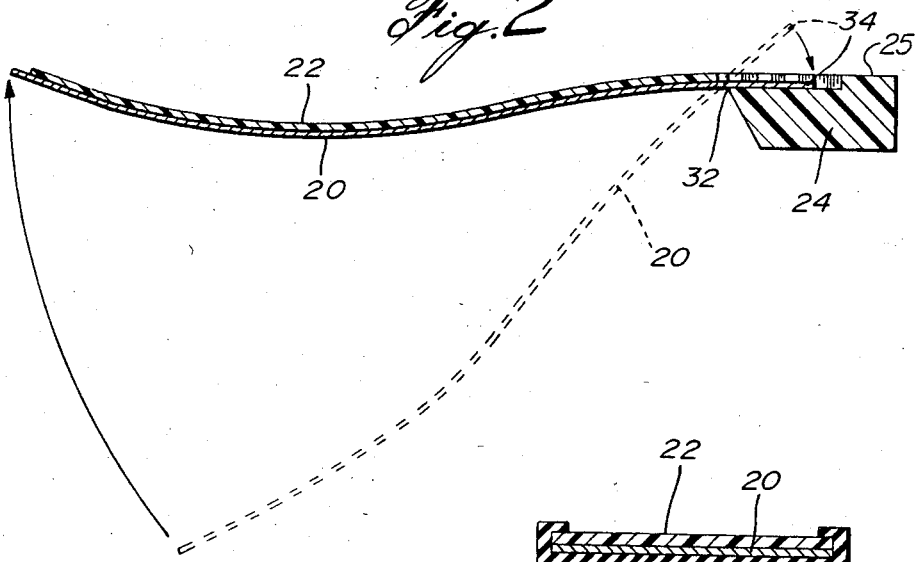
FIG. 2 is a longitudinal cross-section of the sole pieces shown in full lines in FIG. 1.
Figure 4:
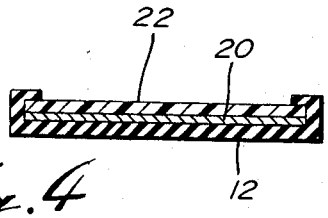
FIG. 4 which is on the same sheet as FIG. 1, is a vertical cross-section taken along line 4—4 of FIG. 3.

Referring now to FIGS. 1 and 2 of the drawings, the sole is constructed as shown in cross-section in FIG. 1 so that the inner construction of the sole can be readily seen. The sole 10 would include an outer sole 12 shown in dotted lines, a heel portion 14, a toe portion 16, and an arch portion 18. As best illustrated in FIG. 2, in addition to the outer sole, there is included a protective mid-sole 20 and an insole 22. The heel includes a heel filler plug 24 integral with the insole 22.

The insole 22 and heel plug 24 are best seen in FIGS. 1, 5 and 7. A heel plug is provided with a recess 26 below the top surface 25 of the plug. The recess 26 extends slightly forward of the heel plug 24 to define a slot 32 in the instep 22. On each side of the recess 26, there are provided saw-tooth projections 28*a*, 28*b*, 28*c* and 28*d* and saw-tooth projections 30*a*, 30*b*, 30*c* and 30*d*.

The insole and heel plug 22 and 24 are formed from a one-piece molding and preferably the material utilized to form the molding would be polyethylene. Such material provides sufficient flexibility and a smooth upper surface for the inside of the boot while the thickened heel plug 24 is sufficient to give the heel 14 rigidity even though the outer sole 12 which would be formed around the heel plug 24 as well as around the insole 22 and mid-sole 20 would be made of a softer rubber material, such as nitrile rubber.

The mid-sole 20 is, as required in a protective boot, made of a stainless steel alloy having at least a thickness of 0.5 mm. Other equivalent materials may be substituted. In the present case, the mid-sole 20 includes a rearwardly extending extension 34 and includes complementary saw-tooth projections 38*a*, *b* and *c* and 40*a*, *b* and *c*. The slot 32 must be wide enough to allow the extension 34 of the mid-sole 20 to pass therethrough and to be seated in the recess 26. The recess 26 must be deep enough such that the slot 32 allows the extension 34 and the mid-sole 20 to lie flat against the instep 22 when the mid-sole 20 is assembled as shown in FIG. 2. The recess 26 has projections 28 and 30 on the side walls of the recess, which are slightly tapered inwardly such that in cross-section, as seen in FIG. 6, it forms a dovetail.

When the mid-sole 20 and particularly the extension 34 is inserted through the slot 32 with the mid-sole being co-extensive under the insole 22, the extension 34 is snapped downwardly into the recess 26 and, of course, the saw-tooth projections 38 and 40 are purposely slightly wider than the top of the recess so that it will have a snap fit while being pressed into the recess. The selection of a plurality of saw-tooth projections, both in the recess 26 and in the extension 34, are provided to allow lengthwise adjustment of the mid-sole relative to the heel and the insole 22 without losing lateral alignment of the mid-sole relative to the insole. The recess can have a second function, that is, to receive projections for keeping the inner sole and mid-sole aligned within the mold when the outer sole 12 is being molded thereon.

The so-formed construction provides a heel plug, inner sole and protective mid-sole formed of two pieces anchored together against lateral movement relative to each other and ready to be placed on the last.

I claim:

1. A sole assembly including a protective mid-sole and an integrally molded insole and heel plug, the plug portion including a top surface, a recessed bed having side walls in the top surface, spaced-apart saw-tooth projections on the side walls in the recessed bed, a slot extending through the insole laterally thereof adjacent the plug and communicating with the recessed bed, the protective mid-sole including a rearward extension adapted to pass through the slot in the insole and be received in the recessed bed, the rearward extension of the mid-sole including complementary saw-tooth projections adapted to be engaged by the saw-tooth projections on the side walls of the recess to provide both lengthwise and widthwise stability.

2. A sole assembly as defined in claim 1, wherein the projections on the side walls of the recessed bed taper inwardly from the bottom of the recessed bed to the top thereof.

3. A sole assembly as defined in claim 1, wherein the rearward extension of the mid-sole can be anchored adjustable as to the relative length thereof within the recessed bed.

* * * * *